US007238459B2

(12) United States Patent
Malachowski

(10) Patent No.: US 7,238,459 B2
(45) Date of Patent: Jul. 3, 2007

(54) METHOD AND DEVICE FOR PROCESSING POWDER

(75) Inventor: Steven M. Malachowski, East Rochester, NY (US)

(73) Assignee: Xerox Corporation, Stamford, CT (US)

( * ) Notice: Subject to any disclaimer, the term of this patent is extended or adjusted under 35 U.S.C. 154(b) by 324 days.

(21) Appl. No.: 10/998,815

(22) Filed: Nov. 30, 2004

(65) Prior Publication Data

US 2006/0115763 A1 Jun. 1, 2006

(51) Int. Cl.
*G03G 9/08* (2006.01)

(52) U.S. Cl. ..... 430/137.1; 366/139

(58) Field of Classification Search ..... 430/137.21, 430/137.1; 366/139, 183.1
See application file for complete search history.

(56) References Cited

U.S. PATENT DOCUMENTS

| | | | | |
|---|---|---|---|---|
| 3,606,270 | A * | 9/1971 | Zimmerly | 366/263 |
| 3,946,996 | A * | 3/1976 | Gergely | 366/139 |
| 4,571,089 | A * | 2/1986 | Gudlauski et al. | 366/139 |
| 6,740,463 | B2 * | 5/2004 | Shigemori et al. | 430/137.18 |

* cited by examiner

*Primary Examiner*—John L Goodrow
(74) *Attorney, Agent, or Firm*—Oliff & Berridge, PLC

(57) ABSTRACT

A powder is de-aerated in a collector and then transferred to a chamber via a valve. The chamber may then be injected with a low-pressure air stream carrying an additive for mixing with the de-aerated powder. The mixing of the powder with the air and additive stream may occur in the valve and/or chamber. After mixing of the powder with the air and additive stream, the mixed powder and additive may be further mixed in the chamber and/or second valve prior to transferring the mixed powder and additive to a holding container or other processing device.

20 Claims, 5 Drawing Sheets

METHOD AND DEVICE FOR PROCESSING POWDER

BACKGROUND

Methods and devices are provided for mixing two or more powders together. In one exemplary embodiment, an additive, for example, silica particles, is added to toner so as to improve the flowability of the toner. The methods and devices, however, are applicable to various types of powders, for example, powders which are combined in preparing food items and in preparing pharmaceuticals.

Dry particles that form a powder, such as dry toner particles, typically are mixed with another material, such as an additive. This is accomplished for various reasons, such as to enhance flow, i.e., a powder made up of both toner and an appropriate additive such as silica may exhibit enhanced flow characteristics.

Toner can be mixed with an additive via many processes. For example, in an emulsion/aggregation chemical toner process, toner provided in a wet-cake form is dried. The drying process can be accomplished by using a torroidal air dryer, for example. The dried toner can then be stored in a collection area. The dried toner, however, tends to become compacted in the collection area because the toner particles have strong cohesive forces. Thus, it is desirable to mix an additive, such as silica, with the toner particles so that the dried toner is easier to handle in subsequent processes.

For example, the additive can be mixed into the dried toner in the collection area. This requires a mixing device to perform the mixing in the collection area, which increases the cost and complicates the process. Another technique would be to add the additive to the toner when it is in its wet-cake form. The additive theoretically would mix with the toner particles during the drying process.

SUMMARY

Because the additive typically has a specific gravity that is lower than the specific gravity of the toner particles, the additive tends to actually separate from the toner particles in the drying device, with the additive particles becoming captured by the filter cartridges of the drying device. The drying devices typically have a dust collection portion in which air is separated from the dried toner particles using, inter alia, filter cartridges. Because the additive particles are less dense than the toner particles, the additive can clog the filter cartridges, which obviously is not desirable. Even worse, the additive is separated from the toner particles rather than becoming mixed with it. To improve mixing, more additive can be added to the wet-cake toner, however, this is wasteful and it does not overcome the problem of clogging the filter cartridges.

Thus, in a first exemplary embodiment, a method of processing powder (such as, for example, toner) introduces a flow additive into the toner while by-passing the dust collector. The method includes introducing the additive subsequent to the separation of the toner particles from air (i.e., subsequent to the dust collector), but before the toner particles enter the product collection area. Thus, according to an exemplary embodiment, additive is mixed with dry toner particles before the particles are collected in the collection area.

In an exemplary embodiment, an additive is blended with the dry toner particles to enable the toner particles to flow more easily even after the toner has settled in a collection area.

In an exemplary embodiment, tubing is used to supply an air and additive stream into the flow of dried toner particles downstream of a dust collector of the drying device. The tubing is placed between two valves of a collection chute. Each of the valves can be, for example, a dump valve, a rotary valve, a butterfly valve, etc. If a valve is used that creates an airlock, for example, a rotary valve, it is possible to use a single such valve, with the tubing emitting the additive on the downstream side of the valve. In operation, the additive in the air stream is dispersed into the toner as the toner enters a chamber downstream of the dust collector. The additive may be fed, for example, using an air fed venturi injection nozzle at a rate to be controlled by an additive feeder. The final toner product is a combination of toner, and a small percentage of the additive, which would give the toner the desired flow characteristics and storage capabilities.

Many alternatives, modifications, and variations of the exemplary embodiments are possible. For example, although in an exemplary embodiment, a venturi injection nozzle is used to control the rate of introduction of additive into the air stream, it is envisioned that any commonly known or later developed method or device to achieve a controlled flow rate of air with additive to inject into the powder processing device may be used. It is also envisioned that any constriction or valve, or any commonly known or later developed method or device to achieve injection of the low-pressure air and additive stream may be utilized.

DETAILED DESCRIPTION OF EXEMPLARY EMBODIMENTS

Exemplary embodiments are described below with reference to the figures. For example, as discussed in detail below, in an exemplary embodiment, the additive is incorporated into the dry toner particles while toner is being processed.

Figure 1:
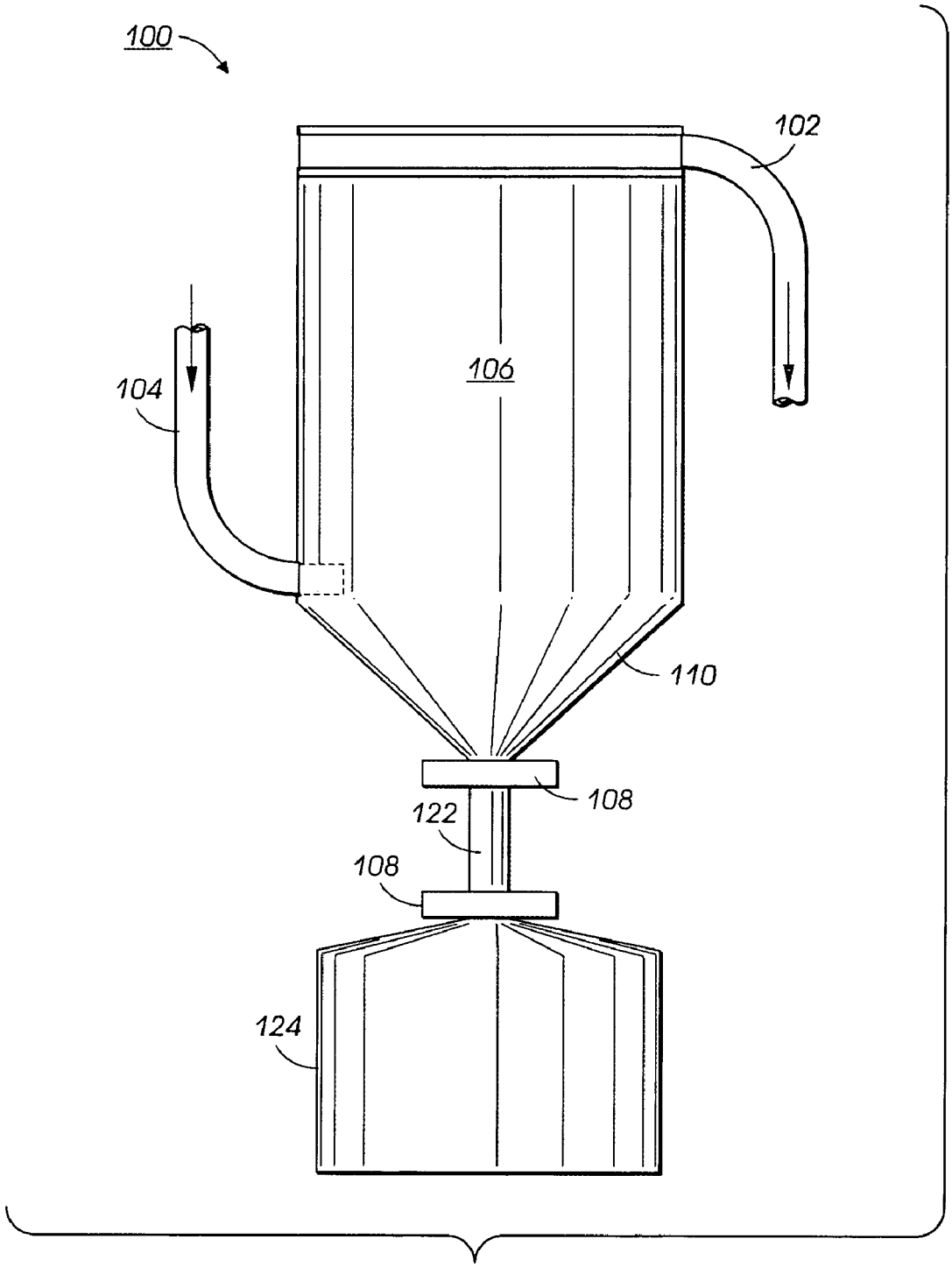
FIG. 1 illustrates a powder processor in an exemplary embodiment.

FIG. 1 shows a powder processor 100 (part of a drying device in this embodiment) with a twin-valve collection chute 122. The powder processor 100 may have an exhaust blower 102, powder entry point 104 and a dust collector 106. The powder entry point 104 may accept powder from a dryer, jet mill, or any like powder application. The powder entry point 104 introduces powder to the dust collector 106. The exhaust blower 102 creates a de-aeration effect such that the powder in the dust collector 106 is de-aerated. The de-aerated powder may be transferred from the dust collector 106 via a first valve 108. More specifically, flanges 110 may guide the de-aerated powder from the dust collector 106 to the valve 108.

Figure 2:
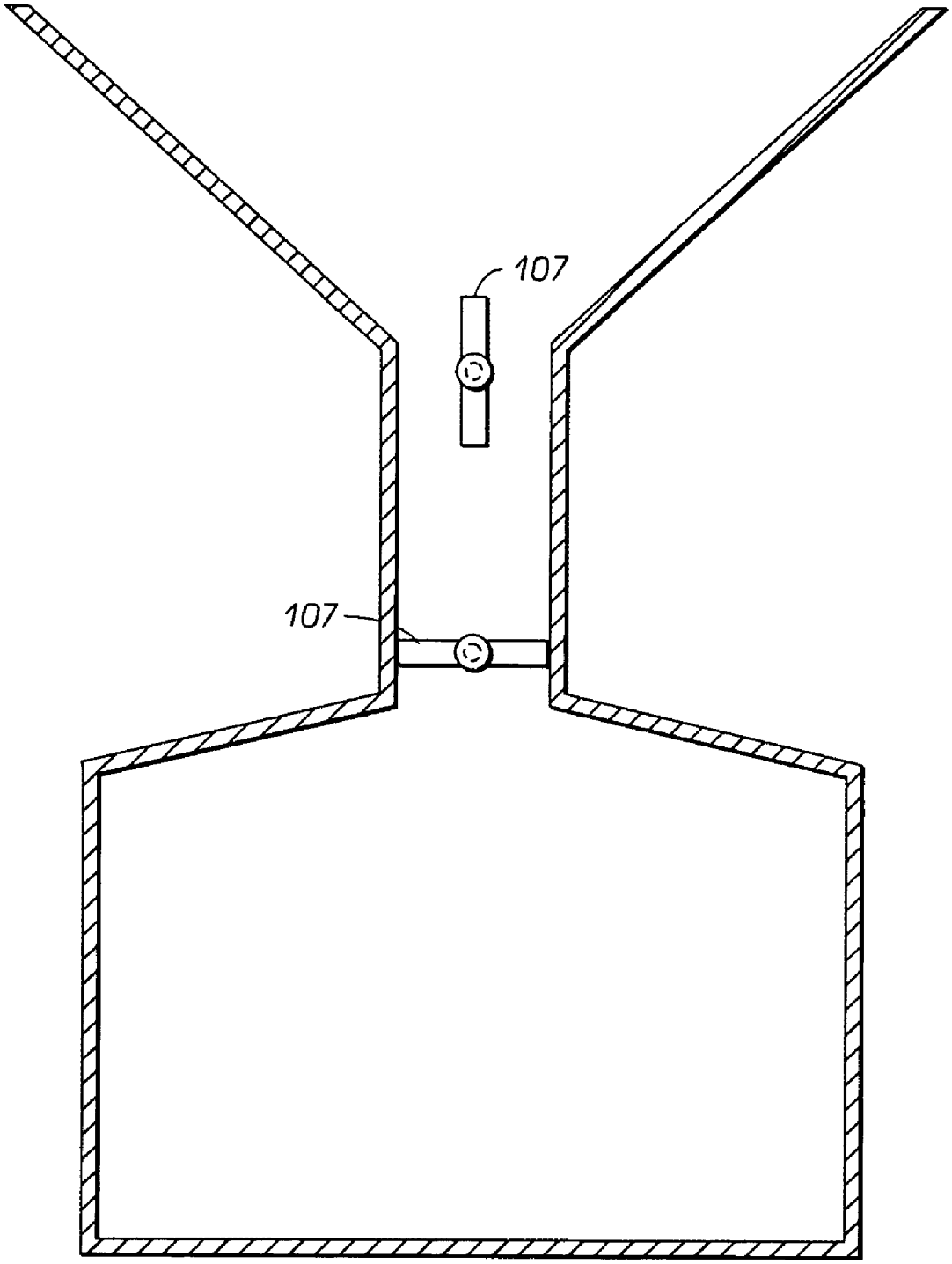
FIG. 2 illustrates twin butterfly valves in a powder processor in an exemplary embodiment.
Figure 3:
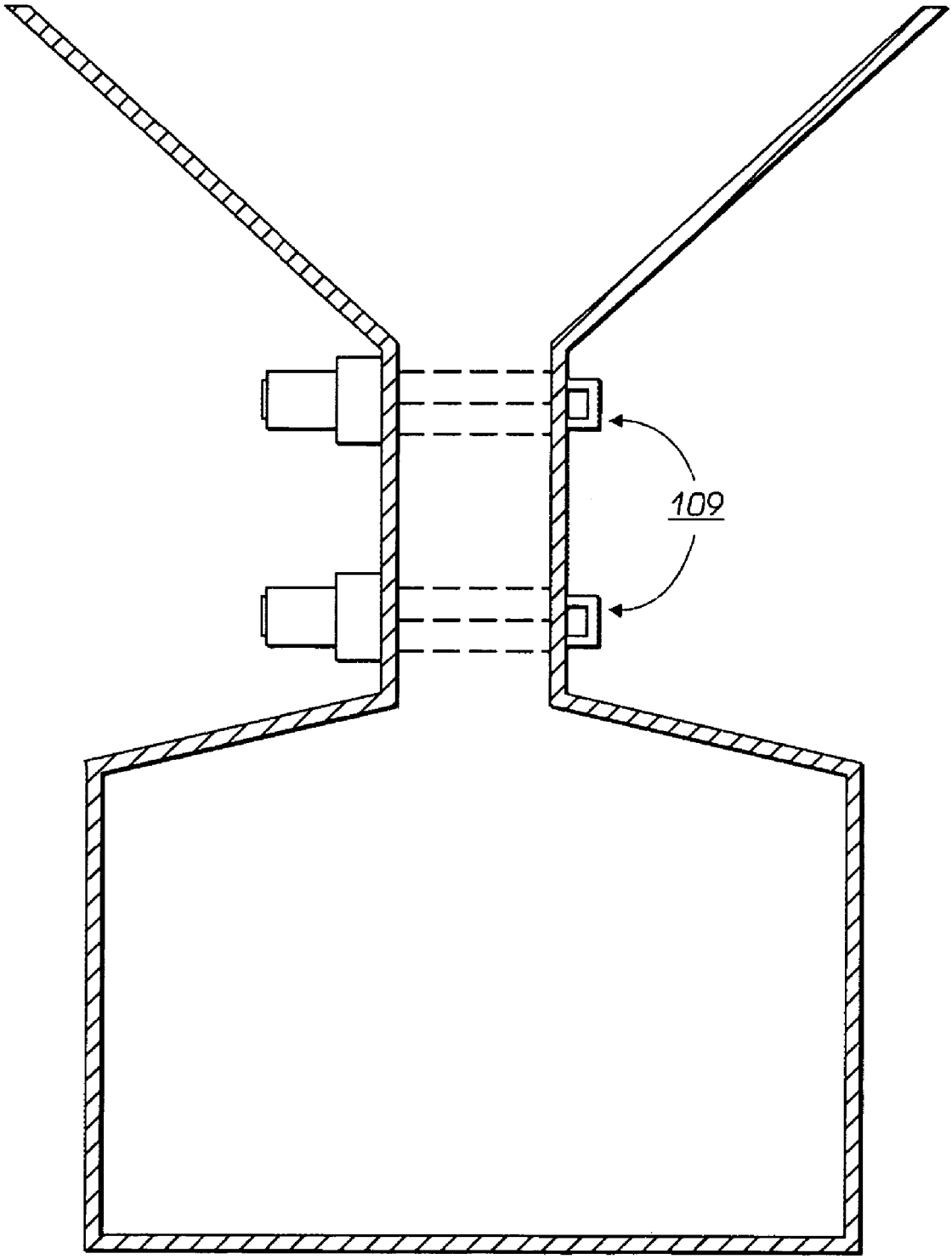
FIG. 3 illustrates twin rotary valves in a powder processor in an exemplary embodiment.

Various types of valves may be used for valve 108. For example, as shown in FIGS. 2 and 3, respectively, a butterfly valve 107, a rotary valve 109, or the like may be used. In a first embodiment, rotary valves may be used. The rotary valve 109 may provide an airlock. A preferred type of rotary valve 109 has a structure like a paddle-wheel. Such a structure is advantageous because it: (1) forms an airlock between the dust collector 106 and the chamber located within chute 122 (which prevents additive from being sucked from the chute 122 into the dust collector 106); and (2) facilitates mixing of the toner particles. However, other valves, such as the butterfly valve 107, may be used. However, if it is desirable for valve 108 to provide an airlock, two butterfly valves 107, which alternately open and close, would be needed to form such an airlock.

Figure 4:
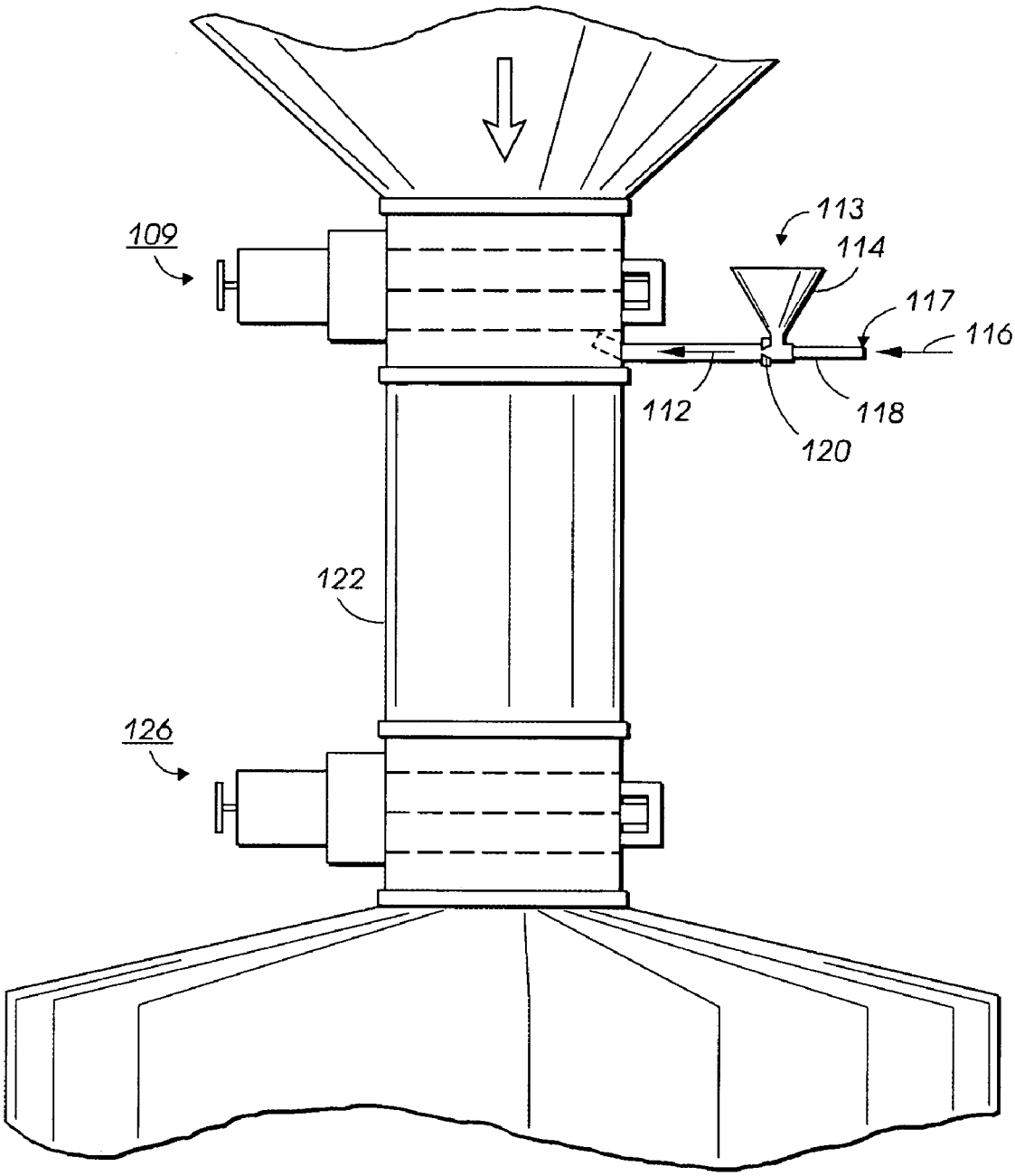
FIG. 4 illustrates an additive feeder for a powder processor in an exemplary embodiment.

As shown in FIG. 4, as the powder is transferred to the valve 109, an air stream 112 carriers an additive 113 and feeds the additive 113 into the toner powder at the valve 109. In an exemplary embodiment, the additive may be any material that may make the powder flow better, such as, for example, silica or the like.

The toner powder in the valve 109 is aerated and the bulk density of the powder is therefore low. The air stream 112 mixes with the toner powder thereby allowing for mixing with the additive. In a preferred embodiment, the air stream 112 may be a low pressure air and additive stream. The air stream 112 may accomplish at least two separate tasks: first, it may supply the powder with an additive, and second, it may serve to blow out any powder captured in (i.e., stuck to) the first valve 109.

The air stream 112 together with the additive 113 may be introduced to the toner powder by way of, for example, a venturi type valve 120. However, any type of positive displacement pump that can push the additive in a feed mechanism with or without the use of air may be used, such as, for example, a cylindrical pump, or the like.

In an exemplary embodiment, at least one additive feeder 114 is provided to introduce the additive 113 into the airstream. Although the additive feeder 114 is shown at an area near the valve 109 in FIG. 4, the additive feeder may be located and attached to the powder processor 100 at any area where mixing of the powder and additive may occur. The additive feeder 114 may be connected to a pipe 118. An inlet 116, at a distal end of the pipe 118, may provide an air stream such that the additive is transferred from the feeder 114, through the pipe 118, to the venturi type valve 120 in the pipe 118. The venturi type valve 120 may cause a reduction in pressure of the air and additive stream which may allow for a low pressure air and additive stream to approach the valve 109. For example, the air and additive stream preferably may have a pressure of 40 psi in a pipe having a diameter of one-eighth inch. However, the pressure may depend on the type of additive, moisture content, cohesivity, etc. of the additive. Thus, there is a wide range of pressures that may be used depending on the type of material being added and the size of the system.

In addition to providing a mechanism in which additive may be added to powder, the air stream 112 may also be used to purge any material stuck to the valve 109, or other part of the processing device.

Although a venturi type valve 120 is discussed above, any device that allows for a low pressure air and additive stream to enter a body for mixing with a powder, may be used, such as, for example, a pump. Furthermore, the venturi type valve 120 creates a negative pressure which may pull the additive from the additive feeder 114 to the pipe 118.

In another exemplary embodiment, the additive is fed to the valve 109 for mixing with the toner powder with a twin intermeshing screw. Such an arrangement does not use an air stream to introduce the additive. It is envisioned that any type of positive displacement pump or device that may feed light and airy material (e.g., powder) may be used, such as, for example, a gate valve, a pinch valve, or the like.

In an alternative embodiment, the additive 113 is simply added to the air stream 112 without the use of a feeder cup or constriction 120. However, in a preferred embodiment, the additive is injection fed, which is advantageous because the air stream helps to remove toner from the valve 109.

In an exemplary embodiment, the toner powder may be mixed with an additive while in the first valve 109. The powder and additive mixture may then be transferred to a chamber within the chute 122. The additive and powder mixture may then be transferred from the chute 122 to a product collection bin 124 (see FIG. 1). The valve 109 may mix the powder by, for example, spinning. The valve 109 may be a rotary valve which may allow for gradually transferring the powder from the dust collector 106 to the chamber in the chute 122.

The powder and additive mixture may fall from the chute 122 to a second valve 126. The second valve 126 is desirable because it separates the mixing zone (within the chute 122) from the collection area (bin 124). In addition, the second valve 126 may act to further blend the toner powder and additive 113. For example, the toner powder and additive 113 may fall from the first valve 109, in a partial "cake" state and thus be in clumps, and thus further mixing is desirable to provide a preferred end product. The second valve 126 may act to break up such clumps, particularly when valve 126 is another rotary valve. Further, some powder may fall through the valve 109, not adhered to any additive 113. With the second valve 126, such powder may "float" and thus be separated from the powder and additive mixture. The floating powder may mix with additive in the chamber of chute 122, or may eventually settle to the second valve 126 to be mixed in with the powder and additive mixture. Thus, in an exemplary embodiment, the second valve 126 may provide an ultimately better quality product.

Figure 5:
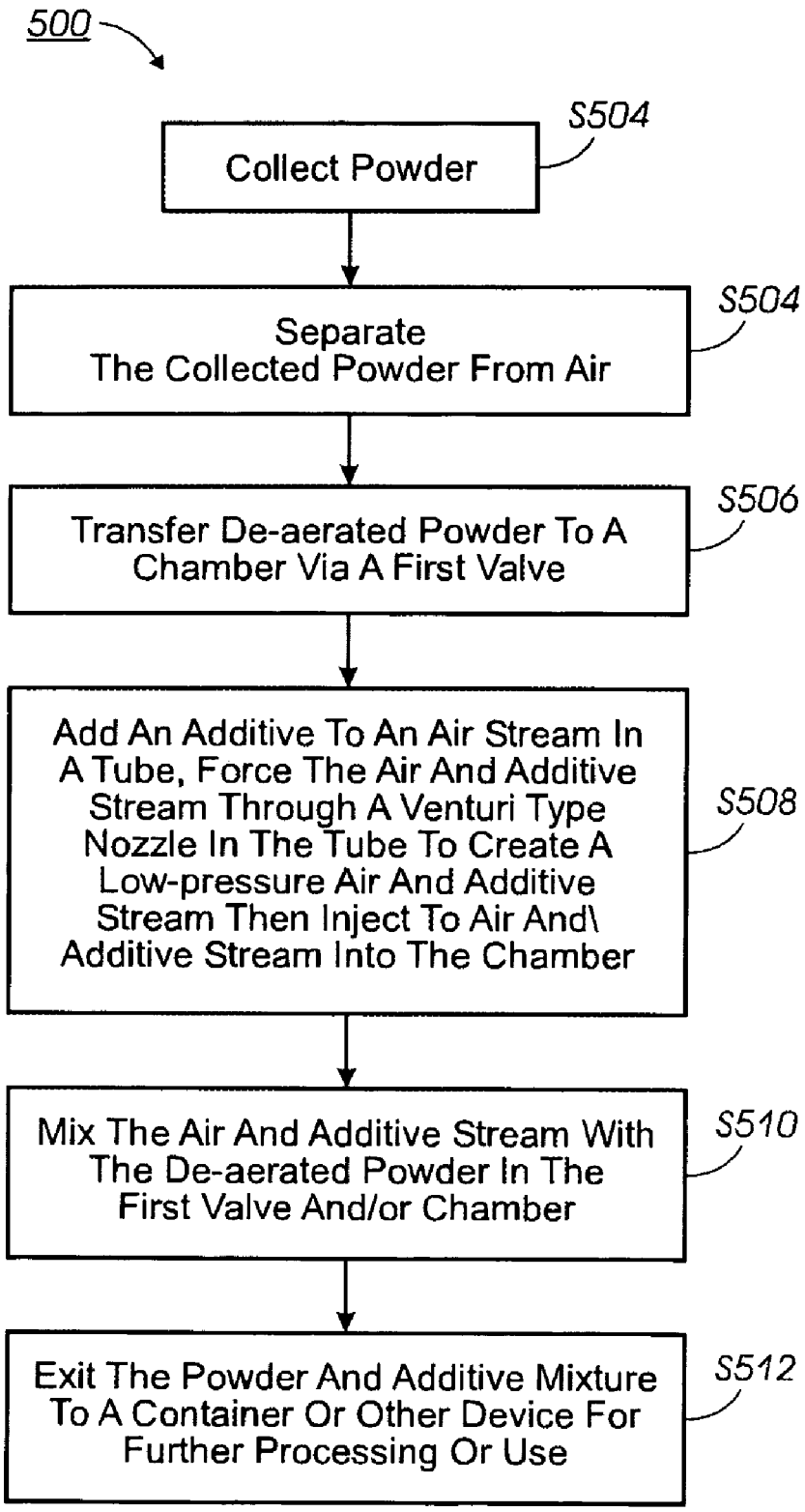
FIG. 5 is a flowchart of a method of processing a powder in an exemplary embodiment.

Referring to FIG. 5, one exemplary method 500 for processing powder is illustrated. Powder may be collected, as shown at step S502. The collected powder may de-aerated by using an exhaust or other device to separate the air from the powder, as shown at S504. The de-aerated powder may then fall to a chamber via a valve, as shown at step S506. An additive may be added to an air stream in a tube, and the air and additive stream may then be forced through a venturi type nozzle in the tube to create a low-pressure air and additive stream for injection into the chamber, as shown at step S508. The injected air and additive stream into the chamber will mix with the powder while the powder is in the valve and/or the chamber, as shown at step S510. After the powder has been mixed with the air and additive stream, the powder may exit to storage via a second valve, as shown at step S512. While in the second valve, the air and additive stream may continue to be mixed.

It is envisioned that the above described exemplary embodiments of a device and method for processing a powder may be used in a number of different processes, such as for example, processing toners for imaging devices, food preparation processes, pharmaceutical processes, or the like. With respect to food preparation and pharmaceutical preparation processes, two or more powders can be mixed to provide a final or intermediate product. In this regard, the word "additive" as used herein is intended to cover another powder which is added to another powder.

Many alternatives, modifications and variations of the exemplary embodiments will be apparent to those skilled in the art. For example, variations may involve different types, shapes and proportions of the main features of the described devices. Accordingly, the embodiments, as set forth above, are intended to be illustrative and not limiting. Various changes may be made without departing from the spirit and scope of the exemplary embodiments.

What is claimed is:

1. A powder processing device for mixing a powder with an additive, comprising:

a powder collector for collecting the powder;

a housing defining a chamber;

a valve disposed between the powder collector and the housing; and a feeder that feeds the additive to the chamber with an air stream, wherein pressure from the air stream enables mixing of the powder and the additive in the chamber, and wherein the feeder includes an additive input tube having an exit end located in the chamber to introduce the additive into the chamber, the exit end of the additive input tube being located adjacent to the valve.

2. The powder processing device of claim 1, wherein the valve is a rotary valve that forms an airlock between the powder collector and the chamber.

3. The powder processing device of claim 2, wherein the exit end of the additive input tube is positioned so that the additive is expelled into the rotary valve.

4. The powder processing device of claim 3, wherein the powder processing device is part of a toner drying device, and the powder is toner particles.

5. The powder processing device of claim 1, further comprising:

a second valve disposed at an end of the housing opposite the valve which is located between the powder collector and the housing.

6. The powder processing device of claim 5, wherein the powder and the additive are mixed at the second valve.

7. The powder processing device of claim 1, wherein the feeder injects the additive along with an air stream into the chamber.

8. The powder processing device of claim 7, further comprising:

a nozzle disposed in a tube of the feeder.

9. The powder processing device of claim 8, wherein the nozzle controls the pressure of the air stream.

10. The powder processing device of claim 1, wherein the powder and the additive are mixed at the valve.

11. The powder processing device of claim 1, wherein the powder processing device is part of a toner drying device, and the powder is toner particles.

12. A method for mixing powder with an additive, the method comprising:

collecting de-aerated powder in a powder collector;

transferring the de-aerated powder to a chamber via a valve; and introducing an additive into the powder in the chamber with an air stream, wherein pressure from the air stream enables mixing of the powder with the additive and wherein the additive is introduced into the chamber via an input tube having an exit end disposed adjacent to the valve.

13. The method for mixing powder with an additive of claim 12, wherein the valve forms an airlock between the powder collector and the chamber.

14. The method for mixing powder with an additive of claim 13, wherein the additive is expelled through an exit end of the input tube so that the additive is expelled into the valve.

15. The method for mixing powder with an additive of claim 12, wherein the powder is toner particles.

16. The method for mixing powder with an additive of claim 12, further comprising:

mixing the powder and the additive at a second valve, wherein the second valve is disposed at an end of the chamber opposite the valve which is located between the powder collector and the chamber.

17. The method for mixing powder with an additive of claim 12, wherein the additive is introduced into the chamber by injecting the additive along with an air stream into the chamber with an input tube.

18. The method for mixing powder with an additive of claim 17, further comprising:

controlling a pressure of the air stream with a nozzle.

19. The method for mixing powder with an additive of claim 12, further comprising:

mixing the powder and the additive at the valve.

20. A method of making toner, the method comprising:

collecting de-aerated toner particles in a collector;

transferring the de-aerated particles from the collector to a chamber via a valve that forms an air-lock between the collector and the chamber; and introducing an additive with an air stream into the chamber so that pressure from air stream enables mixing of the additive with the toner particles, wherein the additive is introduced into the chamber via an input tube having an exit end disposed adjacent to the valve.

* * * * *